United States Patent [19]

Pappas et al.

[11] Patent Number: 4,894,248

[45] Date of Patent: Jan. 16, 1990

[54] WINDOWED BACON PACKAGE

[75] Inventors: John J. Pappas, Kansas City; James G. Keeley, Parkville; Keith D. Bender, Kansas City, all of Mo.

[73] Assignee: Container Corporation of America, Clayton, Mo.

[21] Appl. No.: 320,908

[22] Filed: Mar. 8, 1989

Related U.S. Application Data

[63] Continuation of Ser. No. 79,595, Jul. 30, 1987, abandoned.

[51] Int. Cl.[4] ..... B65D 57/00; B65D 75/00; B65D 77/24

[52] U.S. Cl. ..... 426/121; 426/124; 426/127; 426/129; 428/203; 428/513

[58] Field of Search ..... 426/121, 124, 129, 396, 426/127; 428/203, 205

[56] References Cited

U.S. PATENT DOCUMENTS

| | | | |
|---|---|---|---|
| 3,360,119 | 12/1967 | Mullinix | 426/129 |
| 3,409,445 | 11/1968 | Hall | 426/121 |
| 3,506,467 | 4/1970 | Ulrich | 428/205 |
| 3,667,983 | 6/1972 | Haggas et al. | 428/205 |
| 3,803,332 | 4/1974 | Seiferth et al. | 426/121 |
| 3,978,260 | 8/1976 | Dobbins et al. | 426/121 |
| 4,003,184 | 1/1977 | Shiu | 426/121 |
| 4,097,611 | 6/1978 | Seiferth et al. | 426/121 |
| 4,170,681 | 10/1979 | Edwards et al. | 428/205 |
| 4,268,530 | 5/1981 | Wyslotsky | 426/121 |
| 4,371,553 | 2/1983 | Gilling et al. | 426/121 |
| 4,552,789 | 11/1985 | Winchell | 426/121 |

OTHER PUBLICATIONS

Wiley Encyclopedia of Packaging Technology, Bakker Wiley & Sons, 1986, pp. 430–433, 451–460.

Modern Plastics Encyclopedia, 1984–1985, pp. 284–286.

Packaging Reference Issue 1986, Cahners Publ. Co., pp. 48–50, 87–90, 93–95.

*Primary Examiner*—Steven Weinstein

*Attorney, Agent, or Firm*—Richard W. Carpenter

[57] ABSTRACT

In a package for holding and partially displaying a plurality of bacon slices arranged lengthwise in partially overlapped relation on a relatively thin, flat, opaque, backing member having a window opening for viewing the bacon and overwrapped with a transparent film, an improved backing member that includes a wax saturated paperboard coated on both sides with a layer of low density extruded polyethylene film and having a third layer of film laminated to the entire inner surface of the backing member and covering the window.

3 Claims, 2 Drawing Sheets

WINDOWED BACON PACKAGE

This is a continuation of application Ser. No. 07/079,595, filed 7/30/87, now abandoned.

BACKGROUND OF THE INVENTION

1. Field of the Invention

This invention relates to bacon packages, and more particularly to an improved backing member for supporting a plurality of overwrapped bacon slices.

2. Description of Background Art

A background search directed to the subject matter of the application in the U.S. Patent and Trademark Office disclosed the following U.S. Letters Patent: 2,465,841, 3,029,149, 3,083,106, Des.235,974, 3,083,107, 3,536,501, 3,703,384, Des.250,173, 3,803,332, 3,978,260, 4,003,184, 4,371,553, 4,375,482, 4,552,789.

None of the patents uncovered in the search discloses a bacon package backing member having a window opening located immediately adjacent one edge therof and being formed from a sheet of paperboard having a separate layer of film laminated thereto that covers the entire surface of one side thereof, including the window opening.

SUMMARY OF THE INVENTION

It is an object of the invention to provide an improved backing member for holding a plurality of bacon slices in an overwrapped package.

A more specific object of the invention is to provide an improved bacon package backing member that includes a sheet of paperboard having a bacon viewing window opening located immediately adjacent an edge therof and having a separate sheet of film laminated thereto and covering the entire surface thereof including said window opening.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
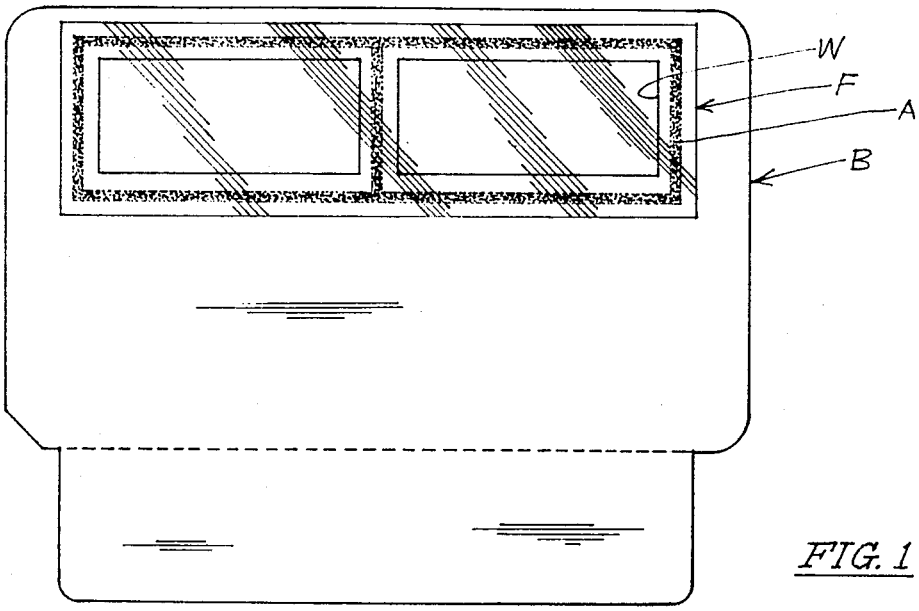
FIG. 1 is a plan view of the inner surface of a conventional bacon package backing member.
Figure 2:
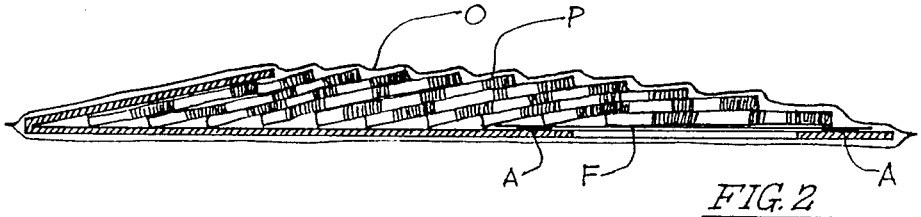
FIG. 2 is a transverse cross sectional view of a conventional bacon package utilizing the backing member illustrated in FIG. 1.
Figure 3:
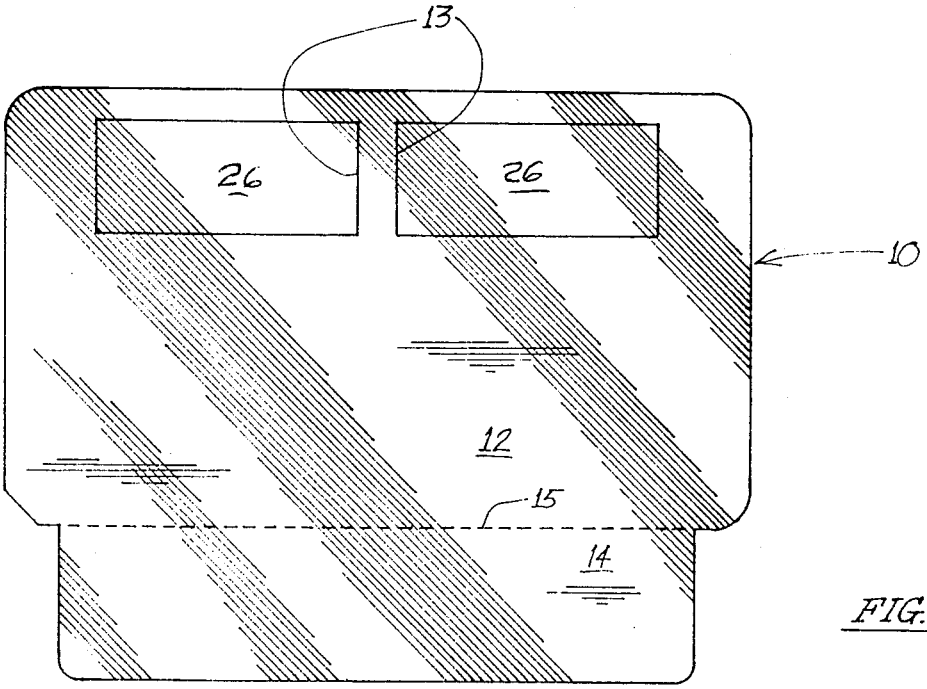
FIG. 3 is a plan view of the inner surface of a bacon package backing member embodying features of the present invention.
Figure 4:
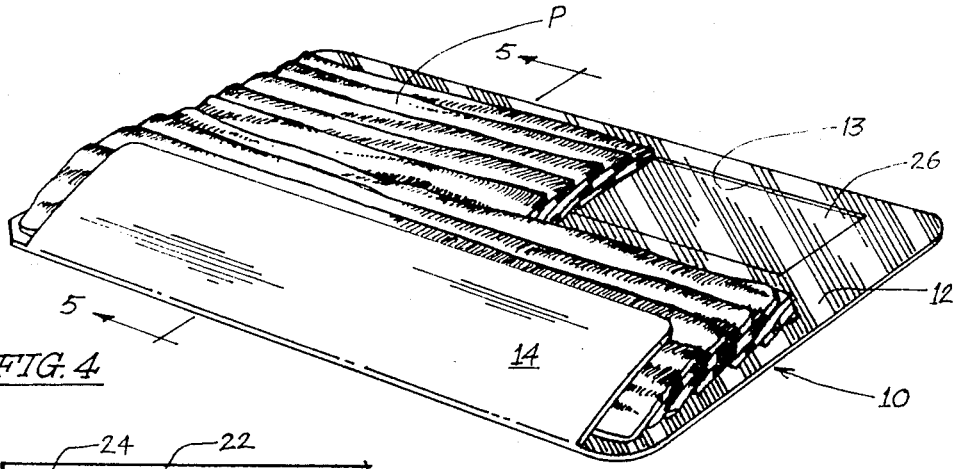
FIG. 4 is a perspective view of a bacon package utilizing the backing member of FIG. 3, but with part of the bacon removed to show how the bottom slice is positioned relative to the window opening.

Referring now to the drawings for a better understanding of the invention, it will be seen that a conventional bacon package is illustrated in FIGS. 1 and 2.

This package includes a backing member B for supporting a product P, such as a plurality of bacon slices positioned lengthwise of the board with their edges overlapped to form a shingle-like arrangement. The member B with the product P is usually overwrapped with a sheet O of clear plastic film.

In order to enable a prospective purchaser to view the underside of a bacon slice, a window opening W is provided in the member near an edge thereof. The window opening W is covered over with a patch F of clear material, such as plastic film, which is glued to the inner surface of the member around the edges of the window opening. In order to attach the film patch F to the member, sufficient space is required between the edge of the window opening and the adjacent free edge of the backing member.

The present invention overcomes this problem, as hereinafter explained, and makes it possible to locate the window opening much closer to the free edge of the member. This is desirable, because it facilitates better "shingling" of the bacon slices and it also helps eliminate edge "curl" of the bacon slices.

In FIGS. 3–7, an embodiment of the present invention is shown. In this embodiment, the package also comprises a backing member, indicated generally at 10, for holding the product, bacon slices P, in a shingled arrangement similar to that in the prior art package, and with a sheet O of clear film overwrapping the bacon P and the backing member 10.

The backing member 10, includes a main support panel 12, for supporting the bacon slices, and a product identification panel 14, which is narrower than panel 12 and which is foldably joined thereto along fold line 15. Main panel 12 is provided with a pair of window openings 13 which are located immediately adjacent the free side edge of panel 12 remote from fold line 15 and identification panel 14.

Figure 7:
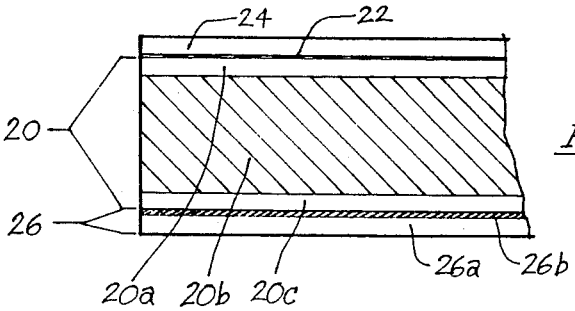
FIG. 7 is an enlarged, vertical, sectional view of a backing member embodying features of the present invention.
Figure 5:
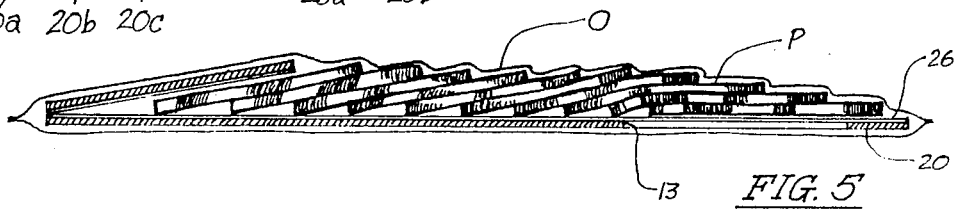
FIG. 5 is a view similar to that of FIG. 2, but embodying features of the present invention.
Figure 6:
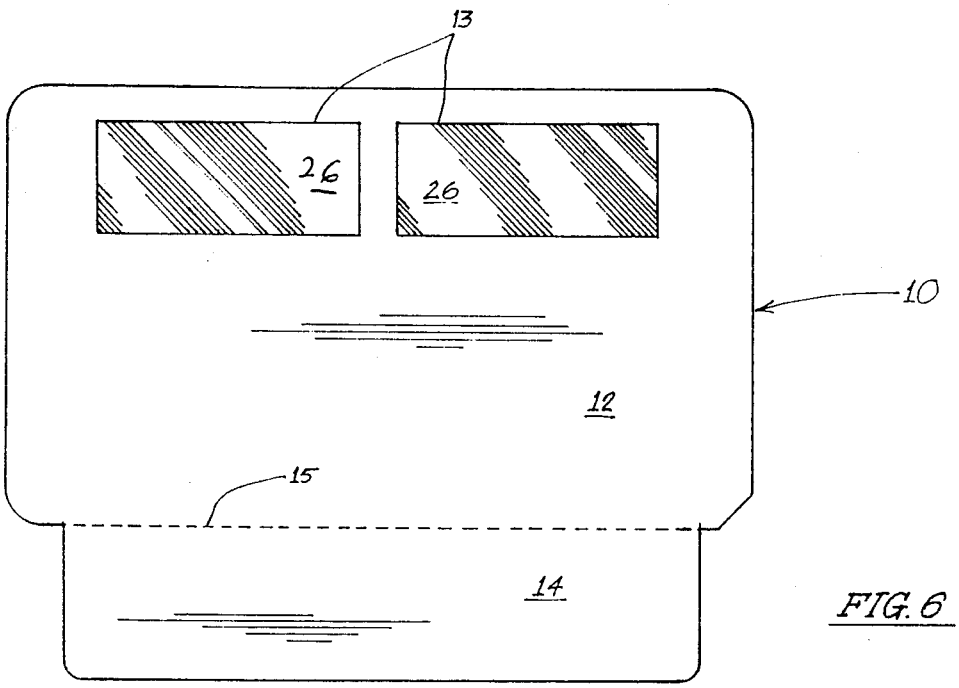
FIG. 6 is a plan view of the outer surface of the backing member illustrated in FIG. 3.

As best seen in FIG. 7, the backing member comprises a central layer or core 20 and an additional film laminate 26 which covers entirely the inner surfaces of both panels 12 and 14, as well as window openings 13.

Central core 20 includes an inner layer **20*b*** of wax saturated, bleached sulphate paperboard which is coated on the outer and inner sides with a low density, extruded film, such as polyethylene.

The film may be pigmented or clear as desired; although, preferably, the outer surface **20*a* is pigmented to take printing, while the inner surface 20*c*** is non-pigmented or clear.

The outer surface of film layer **20*a* may be printed as at 22 and the printing covered with a water base acrylic coating 24**, which protects the printing and allows it to dry better than conventional press varnish.

The essential feature of the present invention resides in the provision of a third layer of film in the form of a film laminate 26, which covers the entire inner surface of both panels 12 and 14 of backing member 10, including each window opening 13.

The film laminate comprises a layer **26*a* of clear, polyester or polypropylene film, which is laminated to the inner surface of layer 20 by means of a heat activated polyolefin adhesive 26*b***.

The addition of the film laminate serves several purposes in addition to providing the third film layer as an additional defense against product wicking.

It also eliminates the need for the inefficient use of space required for a conventionally applied window covering patch of film of the type shown in FIGS. 1 and 2, because laminating over the entire surface allows the window openings to be located as close to the edge of the support panel 12 as desired.

Further, it provides added strength for the backing member.

Additionally, it adds gloss as an appearance enhancement, and it eliminates direct contact of food product with ink on those packages which may have inside printing.

What is claimed is:

1. A sliced bacon package comprising a relatively thin, flat opaque, backing member and a plurality of bacon slices arranged lengthwise in partially overlapped relation on said backing member and overwrapped with a transparent film, said backing member, comprising:

(a) a main support panel presenting an outer surface and an inner surface supporting said bacon slices, and having, immediately adjacent one side edge thereof, at least one window opening extending therethrough to accommodate the viewing of at least a portion of a bottom surface of a lowermost bacon slice;

(b) an additional product identification panel integral with and foldably joined, at one side edge thereof, to another side edge of said main support panel and adapted to be folded back toward said main support panel to overlie at least a portion of an upper surface of an uppermost bacon slice;

(c) said backing member being formed of:

(i) a sheet of wax saturated paperboard, coated on each of said surfaces with a layer of a low density, extruded polyethylene film;

(ii) a third layer of transparent film laminated to the entire inner surface of said coated wax saturated paperboard sheet and completely covering said window opening;

(iii) said third film layer being formed from a material selected from the group consisting of polyester and polypropylene.

2. A package according to claim 1, wherein said third layer of transparent plastic film is polyester.

3. A package according to claim 1, wherein said third layer of transparent plastic film is polypropylene.

* * * * *